United States Patent [19]

Breitenbach

[11] 4,444,132

[45] Apr. 24, 1984

[54] YARN BREAKAGE STOP MOTION DEVICE FOR TEXTILE MACHINES

[75] Inventor: Alfred Breitenbach, Fulda, Fed. Rep. of Germany

[73] Assignee: Dura Tufting GmbH, Fulda, Fed. Rep. of Germany

[21] Appl. No.: 416,674

[22] Filed: Sep. 10, 1982

[30] Foreign Application Priority Data

Jan. 11, 1982 [DE] Fed. Rep. of Germany ..... 3200524

[51] Int. Cl.[3] ..... D05C 15/00

[52] U.S. Cl. ..... 112/79 R; 200/61.18; 66/163; 28/187; 139/370.2

[58] Field of Search ..... 66/163; 112/275, 278; 28/187; 200/61.18; 242/157 R; 139/370.2

[56] References Cited

U.S. PATENT DOCUMENTS

| | | | |
|---|---|---|---|
| 3,429,146 | 2/1969 | Cvach | 66/163 |
| 3,752,997 | 8/1973 | MacKenzie et al. | 28/187 |
| 4,100,425 | 7/1978 | Ohsawa | 28/182 |
| 4,364,247 | 12/1982 | Muns-Magem et al. | 66/163 |

FOREIGN PATENT DOCUMENTS

| | | | |
|---|---|---|---|
| 718242 | 3/1942 | Fed. Rep. of Germany | 66/163 |
| 573796 | 12/1945 | United Kingdom | 66/163 |

*Primary Examiner*—Ronald Feldbaum

*Attorney, Agent, or Firm*—Schwartz, Jeffery, Schwaab, Mack, Blumenthal & Koch

[57] ABSTRACT

Yarn breakage stop motion device for textile machines, in particular for tufting machines, having a number of plates corresponding to the number of yarns to be monitored, utilize plates equipped on both ends with an eye each. One eye serves to guide a yarn to be monitored and the other eye supports the plate on a carrier axle. All plates together form in their entirety a register. A photocell acting on the drive mechanism of the textile machine is arranged such that the pivoting of one or more plates will be detected by the photocell. A plurality of spacer rings are held clampingly against each other on the carrier axle, with each of the spacer rings having on one side an annular shoulder surrounding the carrier axle and the eye serving to support the plate being provided with an aperture, so that the diameter of the eye corresponds to the external diameter of the annular shoulder and the width of the eye aperture to the diameter of the internal opening of the spacer ring or the diameter of the carrier axle.

11 Claims, 3 Drawing Figures

YARN BREAKAGE STOP MOTION DEVICE FOR TEXTILE MACHINES

BACKGROUND OF THE INVENTION

1. Field of the Invention

The invention concerns a yarn breakage stop motion levice for textile machines, particularly tufting ma-:hines, consisting of a number of plates corresponding o the number of the yarns to be monitored. The plates ıre equipped with an eye on both ends, one which erves to guide a yarn to be monitored and the other to ›lace the plate on a carrier axle. The plurality of plates ogether form a register in the pivoting range whereof a ›hotocell acting on the drive mechanism of the machine s arranged.

2. Background of the Prior Art

In a known type of a yarn breakage stop motion levice, the plates are aligned freely on the carrier axle, o that they are not only essentially freely displaceable n the lateral direction, but are also free to tilt within a ange determined by the unavoidable manufacturing olerances of the guide axle and the eye of the plate. In nother known type of a yarn breakage stop motion levice, the plates are guided in a grooved rail consisting ssentially of a square strip into which guide slots are nachined with a predetermined spacing in widths cor-esponding to the thickness of the plates and parallel to ach other. The rail additionally provides a longitudinal ›ore in the area of the webs formed by the machining ›peration. The bore has a diameter corresponding to hat of the eye to receive the carrier axle.

Both known yarn breakage stop motion devices have ertain significant disadvantages. One of the essential lisadvantages consists of the substantial installation ffort required in the case of the removal or insertion of ›ne or several plates into the register. For example, luring damage or the resetting of the machine for a ›roduct with a different yarn distribution the plates requently require removal or additional plates need to ›e inserted. In such a case, it is necessary initially to lisassemble the entire register, followed by the removal ›f all of the plates unilaterally from the terminal plate to he damaged plate. In case of a comb register, this is lone after first retracting the guide axle for the register. The insertion of the replacement plates follows and then eassembly of the register using the plates previously emoved is required. Resetting of the machine by in-talling the register and threading the previously pulled arn then comprises the final step.

The same effort is required in the case of a reequip-nent of the machine. The only difference is that in this nstance, depending on the type of resetting for a prod-ıct with a higher or lower yarn division instead of eplacing a plate, the removal or addition of a plate or everal plates is required.

The second primary disadvantage of the known yarn ›reakage stop motion device is that they do not permit he setting or maintenance of an accurately defined yarn ension. The further consequence of this disadvantage is hat the monitoring of machines so adjusted is not possi-›le, for example, for the production of tufted, looped abric with a yarn breakage stop motion device. It is nown that that the production of tufted, looped or ›oucle fabrics is effected in a manner wherein the yarn ıeedled through the basic fabric is held by a gripper luring the pulling of the needle in order to form a loop vith only the loop that is formed being held to the point in time wherein the needle reaches its upper dead center and is then released. As a precondition of the application of a yarn breakage stop motion device in machines equipped in this manner, it is again necessary to adjust the drop weight of the plates with high accuracy to a low value and to maintain this value permanently. This is required in order to safely prevent the pulling of the loop just formed under the weight of the plate. The known yarn breakage stop motion devices do not permit such an accurate weight adjustment.

SUMMARY OF THE INVENTION

It is the object of the present invention to provide a yarn breakage stop motion device that makes possible a simple removal and/or insertion of plates to replace damaged plates or to alter the division of yarns. This object is achieved according to the invention by providing a plurality of spacing rings on a carrier axle. These rings are held tensioned against each other. The spacing rings are also provided unilaterally with an annular shoulder surrounding the carrier axle. Plate members are mounted on the carrier axle through an eye at one end. The eye holds the plate member which is in turn equipped with an aperture so that the diameter of the eye corresponds to the external diameter of the annular shoulder of the spacing ring. The width of the aperture of the eye corresponds to the diameter of the internal opening of the spacing ring or to the diameter of the carrier axle. The invention provides a yarn breakage stop motion device, whereby in the simplest possible manner, it is possible to replace damaged plates and to reset the installation for a different yarn division without a necessary removal of the register from the machine and without pulling all of the yarns out of the guides just to take off plates in addition to the damaged or superfluous ones. A method of replacing damaged plates of the yarn breakage stop motion device is, therefore, also provided. This method merely requires releasing the clamping device holding the spacing rings against each other (such as by release of a simple threaded nut) and shifting of the spacing rings on the carrier axle to form a gap corresponding to the thickness of a plate between the plate to be removed and the adjacent spacing ring followed by removal of the plate desired by freeing the plate laterally of the annular shoulder holding it and extracting it by means of the aperture in the locating eye over the carrier axis. The insertion of the replacement plate is effected in the reversed order. It is also possible to alter the yarn division by removing or inserting plates. Thus a further method is provided wherein plates are removed or additional plates are inserted. In this procedure, the spacing rings not occupied by plates remain on the carrier axle as blind rings in the register. These spacing rings are clamped in following the adjustment of the register to the yarn division desired without interfering with the yarn breakage stop motion device.

In a preferred embodiment of the invention, the carrier axle is displaceably supported in a slot or elongated hole guide on a support frame and a counter bearing rod is also displaceably supported in a second elongated hold guide. In this manner, the exact adjustment of the drop weight of the plate for any requirement is made possible. At the same time, a setting for the low yarn tensions are permitted in the production of tufted looped fabrics. In this embodiment, the values set remain constant over long periods of time in contrast to the known yarn breakage stop motion devices. For example on the one hand, the plates are guided satisfactorily in all directions. On the other hand, the tilting of the plates and the penetration of dirt or dust between the guiding surfaces to interfere with their functioning is prevented as the result of the compact clamping without clearance of the spacing rings against each other.

BRIEF DESCRIPTION OF THE DRAWINGS

The invention is illustrated in the drawings in the form of an example.

In the drawing:

FIG. 4 shows the manner in which the spacer rings are held together on the axle of the present invention.

DETAILED DESCRIPTION OF PREFERRED EMBODIMENT

Figure 1:
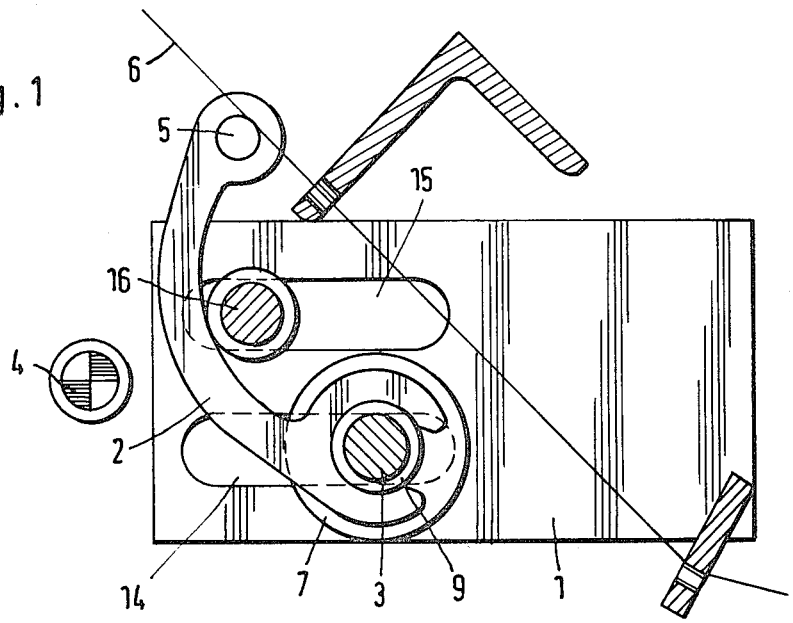
FIG. 1 shows a top view of a yarn breakage stop motion device.

In FIG. 1 of the drawing, 1 designates the support frame mounted in a stationary fashion on the frame of the yarn breakage stop motion device. The support frame 1 comprises a plurality of plates 2 which are aligned in fundamentally arbitrary numbers adjacent to each other. The plurality of plates is not seen in FIG. 1 as such plates are aligned behind one another and mounted on a carrier axle 3. A photocell 4 is located within the pivoting range in the direction of the dropping plates. The photocell acts on the drive machanism of the machine and in cooperation with the plates such that upon the breaking of the yarn 6 passing through the eye 5, the dropping plate intersects the beam of light to the photocell 4 thereby generating a pulse which in turn deactivates the machine drive.

Figure 2:
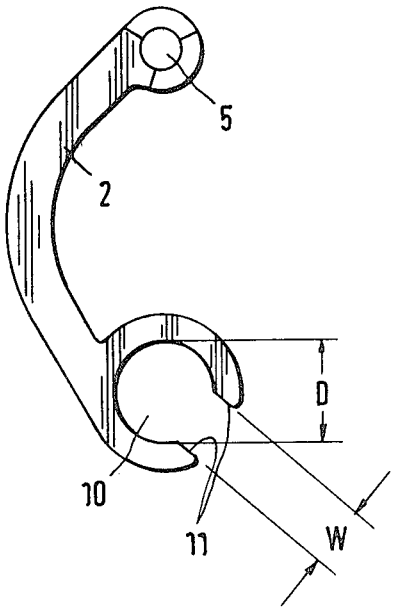
FIG. 2 illustrates a view of a plate member.
Figure 3:
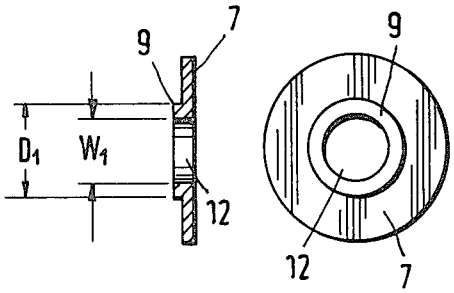
FIG. 3 shows a side view cross section and a front view cross section through a spacing ring.

On the carrier axle 3, as also illustrated in FIGS. 2 and 3, an arbitrary number of spacing rings 7 are held against each other by means of a clamping device (not shown). The spacing rings are provided unilaterally as shown in FIG. 3 with an annular shoulder 9. In FIG. 2, an eye 10 at one end of each plate serves to support such plates 2. The eye also displays an aperture 11. In this design the guiding diameter of the eye 10 corresponds to the external diameter $D_1$ of the annular shoulder 9 and the width W of the aperture 11 corresponds to the diameter $W_1$ of the inner bore 12 of the spacing ring 7. This inner bore 12 generally corresponds to the diameter of the carrier axle 3.

The carrier axle 3 as illustrated in FIG. 1 is supported adjustably in an elongated hole guide 14 in the support frame. A counter bearing rod 16 is located adjustably and displaceably in an adjacent elongated hole 15 and is provided in the pivoting range of the plates 2 in the direction of the yarn tension. This arrangement renders possible (by means of the mutual adjustment of the axle 3 and the rod 16 for the purpose of alignment) the accurate setting of the drop weight of the plate and thus of the tension applied to the yarn being guided. The tension is adjustable to sufficiently low values so that the monitoring even of tufting machines set for the production of looped fabrics is possible.

The clamping of the spacing rings on the carrier axle against each other may be effected by any suitable means. Usually, the clamping means comprises threads on the other or on both sides of the carrier axle and one or two threaded nuts to hold the rings against the shoulder. FIG. 4 shows the arrangement in which two nuts 20 are provided on threads 22 on the ends of axle 3.

In any arrangement of the clamping means, it is however particularly advantageous to permit insertion and/or removal of one or any number of the plates without disassembling the entire apparatus.

In order to remove or insert one or several plates, it is then sufficient to initially release a threaded nut far enough so that a gap corresponding at least to the thickness of a plate is formed between a spacer ring and the annular shoulder of the immediately adjacent spacer ring. The spacer rings are then moved on the carrier axle so that a similar gap is formed next to the annular shoulder of the plate to be removed or inserted. The plate is then extracted by initially pushing it off the annular shoulder laterally and then moving it outwardly over the carrier axle by means of the eye aperture.

The above description describes a preferred embodiment of the invention. It is to be understood however, that the invetnion is not limited to any single embodiment or feature, but should be construed to cover all modifications and alternative embodiments falling within the scope of the invention as defined by the claims which follow.

What is claimed is:

1. A yarn breakage stop motion device comprising:
a support frame;
a carrier axle mounted on said support frame;
a plurality of plate members having two end portions;
a closed eye in the first of said end portions for guiding the passage of yarn therethrough;
an eye with an aperture in the second of said end portions;
means for pivotally and removably mounting said plate members to said carrier axle whereby each plate is held up by yarn passing through its closed eye and drops, pivoting about said axle when the yarn passing through its closed eye breaks, said mounting means comprising:
a plurality of spacer rings mounted on said carrier axle;
means for securing said spacer rings against one another; and
an annular shoulder on each spacer ring surrounding said carrier axle, said shoulder having an external diameter corresponding to the diameter of said eye in the second of said end portions;
wherein the said aperture has a width greater than the diameter of said carrier axle and less than the external diameter of said shoulders; and
means for sensing the dropping of one of said plate members in response to breakage of the yarn passing through the closed eye thereof.

2. The yarn breakage stop motion device of claim 1, wherein the number of plate members correspond to the number of yarns utilized in a textile machine.

3. The yarn breakage stop motion device of claim 2, wherein said textile machine is a tufting machine.

4. The yarn breakage stop motion device of claim 3, wherein the number of plate members correspond to the number of spacer rings.

5. The yarn breakage stop motion device of claim 3, wherein said plurality of plates form a register.

6. The yarn breakage stop motion device of claim 1, wherein said sensing means comprises a photocell.

7. The yarn breakage stop motion device of claim 1 or 6, wherein said means for securing said spacer rings against one another comprises at least one threaded nut.

8. The yarn breakage stop motion device of claim 7, wherein said carrier axle is mounted on said support frame through an elongaged slot, said carrier axle being adjustably supported in said slot.

9. The yarn breakage stop motion device of claim 8, wherein said support frame carries a second elongated slot and a rod stop member adjustably mounted in said second slot.

10. The yarn breakage stop motion device of claim 9, wherein said carrier axle contains threading on at least one end thereof and when said threaded nut communicates with said threaded end.

11. The method of changing the number of plate members in a yarn breakage stop motion device having a support frame; a carrier axle mounted on said support frame; a plurality of plate members having two end portions; a closed eye in the first of said end portion for guiding the passage of yarn therethrough; an eye with an aperture in the second of said end portions; a plurality of spacer rings mounted on said carrier axle; means for securing said spacer rings against one another, and an annular shoulder on each spacer ring surrounding said carrier axle, said shoulder having an external diameter corresponding to the diameter of said eye in the second of said end portions, wherein the said aperture has a width greater than the diameter of said carrier axle and less than the external diameter of said shoulders, said method comprising releasing said means for securing said spacer rings against one another, removing or inserting at least one plate member onto said spacer rings and securing said spacer rings against one another.

* * * * *